US007879517B2

(12) United States Patent
Sakimura et al.

(10) Patent No.: US 7,879,517 B2
(45) Date of Patent: Feb. 1, 2011

(54) ELECTROPHOTOGRAPHIC PHOTORECEPTOR

(75) Inventors: Tomoo Sakimura, Hino (JP); Masahiro Ishie, Hachioji (JP); Shinichi Yabuki, Sagamihara (JP); Hidaya Miwa, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 784 days.

(21) Appl. No.: 11/780,397

(22) Filed: Jul. 19, 2007

(65) Prior Publication Data

US 2008/0057427 A1 Mar. 6, 2008

(30) Foreign Application Priority Data

Aug. 30, 2006 (JP) ..... 2006-233317

(51) Int. Cl.
*G03G 5/047* (2006.01)

(52) U.S. Cl. ..... 430/58.8; 430/60; 430/127

(58) Field of Classification Search ..... 430/58.8, 430/60, 127
See application file for complete search history.

(56) References Cited

U.S. PATENT DOCUMENTS 4,921,773 A * 5/1990 Melnyk et al. ..... 430/132
6,026,262 A * 2/2000 Kinoshita et al. ..... 399/252
2005/0042533 A1* 2/2005 Wu et al. ..... 430/64

* cited by examiner

*Primary Examiner*—Mark F Huff
*Assistant Examiner*—Peter L Vajda
(74) *Attorney, Agent, or Firm*—Lucas & Mercanti, LLP

(57) ABSTRACT

An electrophotographic photoreceptor is disclosed, comprising on an electrically conductive support an intermediate layer, a charge generation layer and a charge transport layer in this order, wherein the charge transport layer contains a charge transport material represented by formula (1) and a compound represented by formula (2) and the content of the compound represented by formula (2) is not less than 100 ppm and not more than 5000 ppm.

formula (1)

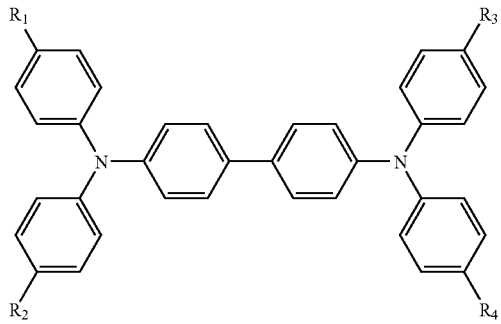

formula (2)

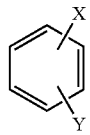

16 Claims, No Drawings

ELECTROPHOTOGRAPHIC PHOTORECEPTOR

This application claims priority from Japanese Patent Application No. JP2006-233317 filed on Aug. 30, 2006, which is incorporated hereinto by reference.

FIELD OF THE INVENTION

The present invention relates to electrophotographic photoreceptors.

BACKGROUND OF THE INVENTION

There have been employed N,N,N',N'-tetra(aryl)-1,1'-biphenyl-4,4'-diamines as a charge transport material, as disclosed in, for example, JP-B No. 63-6864 (hereinafter, the term JP-B refers to Japanese Patent Publication). However, structurally symmetrical N,N'-bis-(4-methylphenyl)-N,N'-bisphenyl-1,1'-biphenyl-4,4'-diamine, which is superior in electric characteristics such as sensitivity, exhibits high crystallinity and crystal deposition during preparation of the photosensitive layer, rendering difficult the use thereof. In practice, there have been mainly used N,N'-bis-(3-methylphenyl)-N,N'-bisphenyl-1,1'-biphenyl-4,4'-diamine, as disclosed in, for example, JP-A Nos. 2001-356500 and 2002-40687, or a mixture containing it as a main component.

Since such structurally symmetrical N,N'-bis-(4-methylphenyl)-N,N'-bisphenyl-1,1'-biphenyl-4,4'-diamine is superior in electric characteristics such as sensitivity, there was attempted preparation of a charge transport layer not exhibiting the foregoing defect but it was difficult to prevent crystal deposition during preparation of the photosensitive layer.

SUMMARY OF THE INVENTION

It is an object of the invention to provide an electrophotographic photoreceptor which is uniform without causing deposition of a charge transport material, and exhibiting no black-spot defects with minimized image defects due to filming.

One aspect of the invention is directed to an electrophotographic photoreceptor comprising on an electrically conductive support an intermediate layer, a charge generation layer and a charge transport layer in this order, wherein the charge transport layer contains a compound represented by formula (1) and a compound represented by formula (2); and the content of the compound represented by formula (2) is not less than 100 ppm and not more than 5000 ppm:

formula (1)

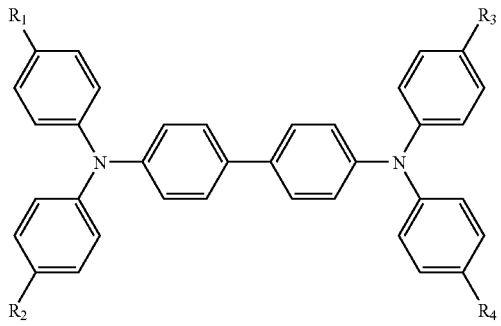

wherein $R_1$, $R_2$, $R_3$ and $R_4$ are each independently a hydrogen atom or a methyl group, formula (2)

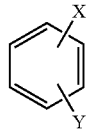

wherein X and Y are each independently a hydrogen atom, an alkyl group, an alkoxy group or a halogen atom, provided that X and Y both are not hydrogen atoms at the same time;

2. The photoreceptor as described above,

Another aspect of the invention is directed to a method of preparing an electrophotographic photoreceptor comprising on an electrically conductive support an intermediate layer, a charge generation layer and a charge transport layer in this order, wherein the charge transport layer is formed by coating a solution comprising a compound of the formula (1) and a solvent of the formula (2).

DETAILED DESCRIPTION OF THE INVENTION

Charge Transport Material

A charge transport material used in the charge transport layer of the invention, represented by the foregoing formula (1) is a N,N'-tetra-(substituted or unsubstituted phenyl)-1,1'-biphenyl-4,4'-diamine compound, which is hereinafter, also denoted simply as TPD. Specific examples thereof include N,N'-bis-(4-methylphenyl)-N,N'-bisphenyl-1,1'-biphenyl-4,4-diamine, N,N,N'-tri-(4-methylphenyl)-N'-phenyl-1,1'-biphenyl-4,4'-diamine, and N,N'-tetra-(4-methylphenyl)-1,1'-biphenyl-4,4'-diamine. Of these, N,N'-bis-(4-methylphenyl)-N,N'-bisphenyl-1,1'-biphenyl-4,4'-diamine (hereinafter, also denoted as p-Me TPD) is preferred in terms of superior electric characteristics such as sensitivity. Of these, N,N'-bis-(4-methylphenyl)-N,N'-bisphenyl-1,1'-biphenyl-4,4'-diamine is preferred.

As a result of extensive studies, it was discovered by the inventors that a charge transport layer prepared by a charge transport layer solution containing N,N'-bis-(4-methylphenyl)-N,N'-bisphenyl-1,1'-biphenyl-4,4'-diamine and a specific solvent, in which no deposition of the charge transport material occurred due to high miscibility of the charge transport material with the solvent, resulted in not only no black spot defect but also reduced image defects due to filming.

It is assumed to be due to the fact that high miscibility inhibits crystal deposition of a charge transport material and matrix formation of a binder resin is completed before formation of not only large crystals (of several μm to several tens mm ϕ and a thickness comparable to a charge transport layer thickness) produced immediately after coating the charge transport layer but also fine crystals (of several tens to several hundreds μm ϕ and a thickness of several μm) produced after the later drying stage of the charge transport layer.

Further, crystal deposition of a charge transport material in the charge transport layer after storage over a long period of time or during usage in an apparatus often produces problems that deposited crystals as nucleuses cause cracking in the charge transport layer. In one of advantageous effects of the invention, a residue of a compound used as a solvent in the charge transport layer inhibits crystal formation of a charge transport material.

The compound of the foregoing formula (1) may be used in any of charge transport materials but accounts for at least 80% by mass of total charge transport materials of the charge transport layer.

With regard to reduction of filming, it is assumed that greatly improved compatibility of a binder and a charge transport material results in uniformity of the charge transport layer, even at a density level of a minute region, leading to enhanced resistance to filming which is presumed to be caused by localized adherence of external developer additives of several tens to several hundreds nm onto highly plastic sites.

Solvent

A solvent having high affinity for TPD is a compound represented by the foregoing formula (2) and specific examples thereof toluene, o-, m- and p-xylene and their mixture, anisole, phenetol, chlorobenzene, and o-, m- and p-chlorobenzene. Of these, toluene and o-, m- and p-xylene are preferred, and toluene is specifically preferred.

In the invention, the content of a compound of the formula (2) is not less than 100 ppm and not more than 5000 ppm, and preferably not less than 500 ppm and not more than 3,000 ppm. In the invention, the content of a compound of the formula (2) is an amount of the compound of the formula (2) contained in the photosensitive layer, wherein the photosensitive layer is comprised of a charge generation layer and a charge transport layer.

The content of a compound of the formula (2), which depends on affinity of a charge transport material for a solvent, can be controlled by drying conditions after coating a charge transport layer. In general, drying a charge transport layer is performed at a temperature near the boiling point of a solvent with controlling a drying time. The drying temperature is preferably from 70 to 150° C. and the drying time is preferably from 30 to 180 min. in terms of productivity.

Solvents usable in combination with the compound of formula (2) include alcohols, ethers and ketones. For example, methanol, ethanol, tetrahydrofuran, dioxane, acetone, methyl ethyl ketone and diethyl ketone are preferred, and tetrahydrofuran is specifically preferred.

A solvent of formula (2) is contained preferably in an amount of at least 10% of total solvents used for a coating solution of a charge transport layer.

The content of a residual solvent in a charge transport layer can be determined, for example, in the following manner.

Measurement Apparatus and Condition:

Instrument: HP5890 (produced by Hewlett Packard Co.)

Column: TC-WAX MEGABORE 30m

Carrier gas: $N_2$ gas

Temperature-raising speed: 10° C./min

Measurement Procedure:

(a) a given amount of solver used for a coating solution of a charge transport layer is sampled and is subjected to gas chromatographic analysis under the foregoing conditions in the instrument described above to prepare a calibration curve between an injection amount and a peak area;

(b) a photosensitive layer including a charge transport layer is peeled off from the support for sampling. The thus peeled photosensitive layer is dissolved in a known high boiling solvent to obtain a solution. The solution is subjected to gas chromatography analysis under same condition and in the same instrument as described above;

(c) an absolute value of the residual solvent content is calculated from the area value obtained in (b) and the calibration curve obtained in (b);

(c) a residual solvent content in the charge transport layer is determined according to the following equation:

residual solve t content (ppm)=[(weight of residual solvent of given weight of photosensitive layer)/(given weight of given weight of photosensitive layer)]×100 charge Transport Layer Resins used for the charge transport layer (which is also denoted as CTL) of the invention include, for example, polystyrene, an acryl resin, a vinyl chloride resin, a vinyl acetate resin, a polyvinyl butyral resin, an epoxy resin, a polyurethane resin, a phenol resin, a polyester resin, an alkyd resin, a polycarbonate resin, silicone resin, a melamine resin and their copolymer resin. In addition to these insulating resins is cited polymer organic semiconductors such as poly-N-vinylcarbazole.

A specifically preferred binder for the CTL is a polycarbonate resin. A polycarbonate resin is specifically preferred for enhancement of dispersibility and electric characteristics of a charge transport material (or CTM). The ratio of a charge transport material to a binder resin is preferably 10 to 200 parts by mass of the charge transport material to 100 parts by mass of the binder resin.

The charge transport layer preferably contains an antioxidant. Such an antioxidant is typically a material capable of preventing or inhibiting action of oxygen under conditions of light, heat, electric discharge or the like, for an auto-oxidizable material existing on the surface or within the organic photoreceptor.

In the invention, the thickness of a charge transport layer is preferably from 10 to 30 μm. A thickness of less than 10 μm tends to cause dielectric breakdown or black spots. A thickness of more than 30 μm often results in blurred images or deteriorated sharpness.

Prior to the stage of coating the charge transport layer, a coating solution is preferably filtered by a metal filter or a membrane filter to remove foreign materials or coagulates contained in the coating solution. It is preferred that for instance, a pleat-type (HDC), a depth-type (Profile) or a semi-depth-type (Profile Star), each produced by Nippon Pole Co., is appropriately chosen according to characteristics of the coating solution to perform filtration.

Charge Generation Layer

A charge generation layer relating to the invention contains a charge generation material (also called CGM). The charge generation layer may further contain a binder resin and external additives. There are usable commonly known charge generation materials (CGM), including, for example, a phthalocyanine pigment, an azo pigment, a perylene pigment and azulenium pigment. Of these, a charge generation material capable of minimizing an increase of residual potential following repeated use is one having a crystal structure capable of forming a stable aggregation structure between plural molecules. Specific examples thereof include phthalocyanine and perylene pigments having a specific crystal structure. For example, a titanyl phthalocyanine (Y-titanyl phthalocyanine) having a maximum peak at a Bragg angle (2θ) of 27.2° for Cu—Kα ray, a titanyl phthalocyanine having a remarkable diffraction peak at a Bragg angle (2θ) of 7.50 and 28.7° and benzimidazole-perylene having a maximum peak at a Bragg angle (2θ) of 12.4°, each CGM exhibits little deterioration after repeated use, while minimizing an increase of residual potential. A specifically preferred charge generation material (CGM) is Y-titanyl phthalocyanine.

When using a binder as a dispersing medium in the charge generation layer, there are usable commonly known resins as the binder and examples of preferred resins include a formal resin, a butyral resin, a silicone-modified butyral resin and a phenoxy resin. The ratio of a charge generation material to a binder resin is preferably from 20 to 600 parts by mass to 100 parts by mass of a binder resin. These resins can minimize an increase of a residual potential with repeated use. The thickness of the charge generation layer is preferably from 0.01 to 1 μm. A layer thickness of less than 0.01 μm does not achieve sufficient sensitivity characteristic and tends to increase a residual potential. A layer thickness of more than 1 μm often causes dielectric breakdown or black spotting.

Similarly to the coating solution of the charge transport layer, it is preferred to filtrate the coating solution of a charge generation layer by a metal filter or a membrane filter prior to coating the charge generation layer to remove foreign materials or coagulates contained in the coating solution.

Intermediate Layer

In the invention, an intermediate layer is provided between a conductive support and a photosensitive layer. The intermediate layer preferably contains N-type semiconductor particles. The N-type semiconductor particles mean those in which the main charge carrier is an electron. Thus, since the main charge carrier is an electron, an intermediate layer containing the N-type semiconductor particles efficiently blocks hole-injection from the substrate and exhibits the property of being little blocking for electrons from the photosensitive e layer.

Herein, there will be described a method of identifying N-type semiconductor particles.

A 5 μm thick intermediate layer is formed on a conductive support by using a dispersion of 50 mass % particles dispersed in a binder resin used for the intermediate layer. The interlayer is negatively charged and its light decay characteristic was evaluated. Similarly, the interlayer is positively charged and its light decay characteristic was evaluated. In the foregoing evaluations, when the light decay of being negatively charged is larger than that of being positively charged, particles dispersed in the intermediate layer represent N-type semiconductor particles.

Metal oxides such as titanium dioxide ($TiO_2$) and zinc oxide (ZnO) are preferably used as N-type semiconductor particles and titanium dioxide is more preferred. Titanium dioxide particles include an anatase type, an rutile type, a brokite type and an amorphous type. Of these, the anatase type titanium dioxide pigment or the rutile type titanium dioxide enhances rectifying a charge passing through the intermediate layer or enhances movement of electrons, resulting in a stabilized charge potential and preventing an increase of residual potential and occurrence of spotting.

N-type semiconductor particles are preferably those which were previously surface-treated with a polymer comprising a methyl hydrogen siloxane unit. A polymers comprising a methyl hydrogen siloxane unit and having a molecular weight of 1000 to 20000 effectuates enhanced surface treatment, resulting in enhanced rectifying capability of N-type semiconductor particles. Accordingly, the use of such N-type semiconductor particles prevents occurrence of black spots and is effective in half tone image formation.

The polymer comprising a methyl hydrogen siloxane unit is preferably a copolymer comprising a structural unit of —[HSi($CH_3$)O]— and other structural unit (other siloxane units). Of other siloxane units, a dimethylsiloxane unit, a methylethylsiloxane unit, a methylphenylsiloxane unit or diethylsiloxane unit is preferred and a dimethylsiloxane unit is specifically preferred. The content of methyl hydrogen siloxane in a copolymer is preferably 10 to 99 mol % and more preferably 20 to 90 mol %.

A methyl hydrogen siloxane copolymer may be any one of a random copolymer, a block copolymer and a graft copolymer, but a random copolymer or a block copolymer is preferred. The copolymer may be comprised of a single component or two or more components in addition to methyl hydrogen siloxane.

N-type semiconductor particles may be surface-treated with a reactive organic silicone compound represented by the following formula (3):

$$(R)_n\text{—Si—}(Xa)_{4-n} \qquad \text{formula (3)}$$

wherein Si is a silicon atom, R is an organic group in which a carbon atom is attached directly to the silicon atom, Xa is a hydrolysable group, and n is an integer of 0 t0 3.

In the organic silicone compound of formula (3), examples of an organic group in which a carbon atoms is attached to the silicon atom include an alkyl group such as methyl, ethyl, propyl, butyl, pentyl, hexyl, octyl, and dodecyl; an aryl group such as phenyl, tolyl, naphthyl, and biphenyl; an epoxy-containing group such as γ-glycidoxypropyl, β-(3,4-epoxycyclohexyl)ethyl; a (meth)acryloyl-containing group such as γ-acryloxypropyl, and γ-methacryloxypropyl; a hydroxy-containing group such as 7-hydroxypropyl and 2,3-dihydroxypropyloxypropyl; a vinyl-containing group such as vinyl and propenyl; a mercapto-containing group such as γ-mercaptopropyl; an amino-containing group such as γ-aminopropyl and N-β(aminoethyl)-γ-aminopropyl; a halogen-containing group such as γ-chloropropyl, 1,1,1-trifluoropropyl, nonafluorohexyl and perfluorooctylethyl; a nitro group and cyano-substituted alkyl group. Examples of a hydrolysable group of X include an alkoxy group such as methoxy and ethoxy, a halogen group and an acyloxy group.

The organic silicone compounds of formula (3) may be used alone or in combination. In the organic silicone compound of formula (3), when "n" is 2 or more, plural Rs may be the same or different, and when "n" is 2 or more, plural Xas may be the same or different. When two or more compounds of formula (3) are used, R and Xa each may be the same or different between compounds.

Prior to the surface treatment of methyl hydrogen siloxane or a reactive organic silicone compound, N-type semiconductor particles may be subjected to an inorganic surface treatment of alumina or silica.

The foregoing alumina and silica treatments may be conducted simultaneously but it is preferred to perform the alumina treatment, followed by the silica treatment. When conducting the alumina and silica treatments, respectively, the treatment amount of silica is preferably more than that of alumina.

In the invention, N-type semiconductor particles may be prepared, before or after the foregoing surface treatment, in the stage including a dispersion step by using media. Specifically, N-type semiconductor particles are prepared to those having a number average primary particle size of 3.0 to 100 nm in the stage including a dispersion step by using spherical media mainly composed of zirconium oxide and having an average particle size of 0.1 to 0.5 mm. In the dispersion step, there are commonly known dispersing machines using dispersing media, such as a vertical sand mill or a horizontal sand mill. Using these dispersing machines, N-type semiconductor particles are dispersed in a binder which is identical to the binder used in the intermediate layer. Specifically preferred dispersing machines include DISPERMAT (trade name) SL-M-Ex5-200 and SL-C-EX5-200, produced by VMA-GETZMANN Co.

The number average primary particle size of N-type semiconductor particles obtained after dispersion is a value obtained in such a manner that 100 particles are microscopically observed as primary particles by a transmission electron microscope at a magnifying power of 10,000 and measured as a Feret average diameter through image analysis. N-type semiconductor particles having a number average primary particle size of less than 3.0 nm are difficult to be homogeneously dispersed in a binder of the intermediate layer and often form aggregated particles, which act as a charge trap and cause transfer memory. On the other hand, N-type semiconductor particles having a number average primary particle size of more than 100 nm easily form protrusions on the surface of the intermediate layer and dielectric breakdown or black-spotting often occurs through these large protrusions. Further, N-type semiconductor particles having a number average primary particle size of more than 100 nm easily deposit in a dispersion, easily forming aggregates.

A coating solution to form the intermediate layer used in the invention is composed of a binder resin, a dispersing solvent and the like other than the foregoing N-type semiconductor particles.

The volume of N-type semiconductor particles used in the intermediate layer is preferably 0.5 to 2.0 times that of a binder resin of the intermediate layer. Such a high density of N-type semiconductor particles in the intermediate layer results in enhanced rectification and even when the layer thickness is increased, neither an increase of residual potential nor spotting occur and black spots are effectively prevented, thereby forming an organic photoreceptor exhibiting little potential variation and capable of forming a superior halftone image. The intermediate layer contains N-type semiconductor particles preferably in an amount of 50 to 200 parts by volume.

As a binder resin which disperses these particles and forms an intermediate layer structure is preferably a polyamide resin. Specifically, the polyamide resin as described below is preferred. Namely, a polyamide resin exhibiting a heat of fusion of 0 to 40 J/g and a water absorption coefficient of not more than 5% is preferred as a binder of the intermediate layer. The heat of fusion is more preferably 0 to 30 J/g and still more preferably 0 to 20 J/g. A water absorption coefficient of more than 5% results in an increased water content in the intermediate layer, lowered rectification of the intermediate layer and occurrence of black-spotting, leading to deteriorated halftone images. The water absorption coefficient is more preferably not more than 4%.

The heat of fusion of the resin described above can be measured in differential scanning calorimetry (DSC). However, the measurement of a heat of fusion is not always limited to the DSC, if it is the same measurement value as measured in the DSC. The water absorption coefficient of a resin can be determined through mass change by a water immersion method or the Karl-Fischer method.

Alcohol-soluble polyamide resin is preferred as a binder of the intermediate layer. A binder of the intermediate layer of an organic photoreceptor requires superior solubility in solvent. There are known copolymer polyamide resins composed of a chemical structure having less carbon atoms between amide bonds, such as 6-nylon and methoxymethylated polyamide as an alcohol-soluble polyamide, however, these resins exhibit a high water absorption coefficient and an intermediate layer using such a polyamide tends to exhibit high environmental dependency, resulting in a charging characteristic or sensitivity which easily varies under high temperature and high humidity or under low temperature and low humidity, often causing black spotting or deterioration of halftone images.

Alcohol-soluble polyamide resin improves defects, as described above. Thus, characteristics of a heat of fusion being 0-40 J/g and a water absorption coefficient of not more than 5% by mass minimizes defects of conventional polyamide resins, whereby superior electrophotographic images can be obtained even when the external environment changes or an organic photoreceptor is continuously used over a long period of time.

Examples of preferred polyamide usable in the invention include N-1 to N-11 described in JP-A No. 2006-309116 (paragraphs 0122-0124).

The number average molecular weight of a polyamide resin is preferably from 5,000 to 80,000, and more preferably from 10,000 to 60,000. A number average molecular weight of less than 5,000 deteriorates uniformity of the intermediate layer, resulting in insufficient advantageous effects of the invention. A number average molecular weight of more than 80,000 lowers solvent solubility of the resin, often forming aggregated resin in the intermediate layer and causing black spotting or deteriorated halftone images.

The foregoing polyamide resin is commercially available, for example, Best Melt X1010 and X4685 (trade name) are available from DAICEL-DEGUSA. Co., Ltd. but can be prepared by generally known synthesis methods of polyamides.

Solvents used for dissolving the foregoing polyamide resin to prepare a coating solution are preferably alcohols having 2 to 4 carbon atoms, including, for example, ethanol, n-propyl alcohol, isopropyl alcohol, n-butanol, t-butanol and sec-butanol. These solvents preferably account for 30 to 100%, more preferably 40 to 100%, and still more preferably 50 to 100% by mass of the total solvents. Examples of an auxiliary solvent which is usable in combination with the foregoing solvents and achieves preferred effects, include methanol, benzyl alcohol, toluene, methylene chloride, cyclohexanone and tetrahydrofuran.

In the invention, the thickness of the intermediate layer is preferably from 0.3 to 10 μm, and more preferably from 0.5 to 5 μm. A thickness of more than 10 μm often causes an increase of residual potential or black spotting and resulting in deteriorated sharpness.

The intermediate layer is preferably an insulation layer. The insulation layer refers to a layer exhibiting a volume resistance of not less than $1\times10^{8}$ Ω·cm. In the invention, the volume resistance of an intermediate layer or a protective layer is preferably from $1\times10^{8}$ to $1\times10^{15}$ Ω·cm, more preferably from $1\times10^{9}$ to $1\times10^{14}$ Ω·cm, and still more preferably from $2\times10^{9}$ to $1\times10^{13}$ Ω·cm. The volume resistance can be measured, for example, as below:

Measurement condition: JIS C2313-Measurement instrument: Hiresta IP (produced by Mitsubishi Yuka Co.)

Measurement probe: HRS

Applied voltage: 500 V

Measurement environment: 30±2° C., 80±5% RH.

A volume resistance of less than $1\times10^{8}$ Ω·cm results in lowered charge blocking capability of the intermediate layer, increased black spots and deteriorated potential retention of an organic photoreceptor, accordingly, superior image quality cannot be achieved. On the other hand, a volume resistance of more than $1\times10^{15}$ Ω·cm often increases residual potential, while repeating image formation, so that superior image quality cannot be achieved.

Conductive Support

Electrically conductive support used in the invention may be in a sheet form or a cylindrical form but the cylindrical conductive support is preferred in design of a more compact image forming apparatus.

The cylindrical conductive support means a cylindrical support enable to endlessly achieve image formation through rotation. A cylindrical conductive support with a straightness of 0.1 mm or less and a deflection of 0.1 mm or less is preferred. A straightness and a deflection exceeding these ranges render it difficult to achieve superior image formation.

There are usable a metal drum such as aluminum or nickel as conductive material, a plastic drum on which aluminum, tin oxide or indium oxide is deposited and a conductive material-coated paper or plastic drum. There is preferred a conductive support exhibiting a specific resistance of not less $10^3$ Ω·cm at ordinary temperature. An aluminum support is specifically preferred as a conductive support usable in the invention. The aluminum support may contain components such as manganese, zinc or magnesium other than aluminum as a main component.

EXAMPLES

The present invention will be described with reference to examples but is by no means limited to these. In Examples, "part(s)" represents parts by mass, unless otherwise noted.

Preparation of N-Type Semiconductor Particles

In 10 parts of a mixture of ethanol/n-propyl alcohol/THF (45:20:35 by volume) was dissolved 0.1 parts of copolymer of methylhydrogen-siloxane and dimethylsiloxane (1:1). Further thereto was added 3.5 parts of rutile type titanium dioxide (having a number average primary particle size of 35 nm and having been subjected to a 5% alumina primary surface treatment by alumina), stirred for 1 hr. to perform a surface treatment (secondary treatment) and separated from the solvents. There was titanium oxide particle 1 as surface treated N-type semiconductor particles.

Titanium oxides 2 and 3 were each prepared similarly to the foregoing titanium oxide 1, except that the number average primary particle size was changed to 3 and 100 nm, respectively.

Preparation of Photoreceptor 1

Intermediate Layer:

To 10 parts of a solvent mixture of ethanol/n-propyl alcohol/THF (45:20:35 by volume) was added 1 part of a binder resin (N−1), dissolved with stirring at 65° C., and after cooled to room temperature, filtered (Profile II, produced by Nippon Paul Co., rated filtration accuracy of 5 μm). Further thereto, 3.5 parts of the foregoing surface-treated N-type semiconductor particles 1 was added and dispersed using DISPERMAT (registered trademark) SL-M-Ex 5-200, produced by VMG-GETZMANN Co. and spherical beads mainly composed of zirconium oxide having an average particle size of 0.1 to 0.5 (beads example: YTZ ball, produced by Nikkato Co., Ltd., filling rate: 80%) at a circumferential speed of 4 m/sec for a mill retention time of 3 hrs. to obtain an intermediate layer dispersion 1. The dispersion was diluted to two times using a solvent mixture having the same composition, allowed to stand for two days and nights, and filtered (Profile, produced by Nippon Paul Co., rated filtration accuracy of 5 μm) to obtain intermediate layer coating solution 1.

Intermediate layer coating solution 2 was prepared similarly to the intermediate layer coating solution 1, except that N-type semiconductor particles were changed to the titanium oxide 2 and the average particle size of dispersing media was changed to 0.1 mm.

Intermediate layer coating solution 3 was prepared similarly to the intermediate layer coating solution 1, except that N-type semiconductor particles were changed to the titanium oxide 3 and the average particle size of dispersing media was changed to 0.5 mm.

Intermediate layer coating solution 4 was prepared similarly to the intermediate layer coating solution 1, except that the dispersion media was changed to spherical media composed mainly of glass beads (High-Bea D24) having an average particle size of 0.8 mm.

The prepared intermediate layer coating solution 1 was coated by an immersion coating method on a washed cylindrical aluminum substrate (which was machined to a ten-point surface roughness (Rz) of 0.81 μm, defined in JIS B-0601) to form an intermediate layer 1 having a dry thickness of 1.5 μm.

Binder resin (N-1)

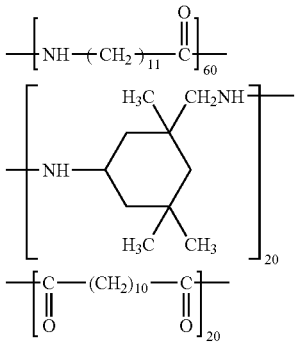

Charge Generation Layer:

Components described below were mixed and dispersed by using a sand mill dispersing machine to prepare a coating solution of a charge generation layer. The coating solution was coated by an immersion coating method to form a charge generation layer having a dry thickness of 0.3 μm on the foregoing intermediate layer.

| | |
|---|---|
| Y-titanyl phthalocyanine* | 20 parts |
| Polyvinyl butyral (BX-1, Produced by Sekisui Kagaku Co., Ltd.) | 10 parts |
| Methyl ethyl ketone | 700 parts |
| Cyclohexane | 300 parts |

*Thitanyl phthalocyanine pigment having a maximum diffraction peak at a Bragg angle (2θ ± 0.2°) of 27.3° in a diffraction spectrum of Cu—Kα characteristic X-ray.

Charge Transport Layer:

Components described below were mixed and dissolved to prepare a coating solution for a charge transport layer. The prepared coating solution was coated onto the foregoing charge generation layer by an immersion coating method and dried under the drying conditions shown in Table 1 to form a charge transport layer having a dry thickness of 18 μm to prepare electrophotographic photoreceptor 1.

| | |
|---|---|
| Charge transport material | 70 parts |
| Binder (compound shown in Table 1) | 100 parts |
| Antioxidant (Compound A) | 8 parts |
| Solvent (shown in Table 1) | 750 parts |

Preparation of Photoreceptors 2-21

Electrophotographic photoreceptors 2-21 were prepared similarly to the foregoing electrophotographic photoreceptor 1, provided that an intermediate later coating solution, a charge transfer material (or CTM), solvents, a binder and drying conditions were changed, as shown in Table 1.

Compounds shown in Table 1 are as follows.

Binder 1: copolymer binder in a ratio of unit A to unit B of 80:20

Binder 2: polymer binder of the unit shown below

Binder 3: polymer binder of the unit shown below

THF: tetrahydrofuran

MC: methylene chloride

Tol: toluene

Xy: p-xylene

CB: chlorobebzene

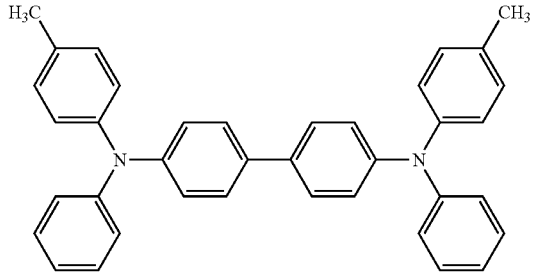

p-MeTPD (denoted as "p" in Table 1)

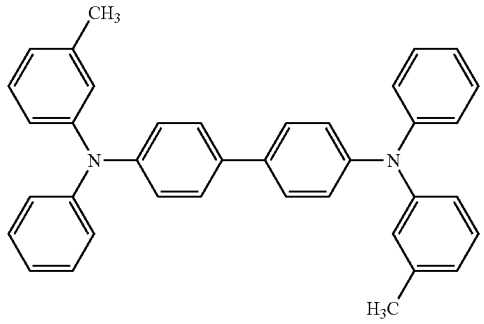

m-MeTPD (denoted as "m" in Table 1)

Compound A

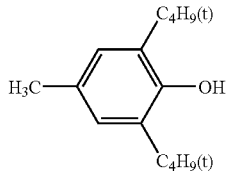

Binder 1

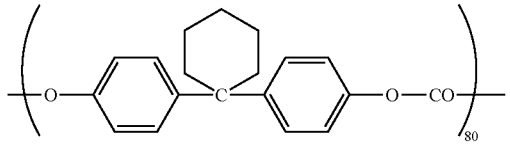

Unit A

-continued

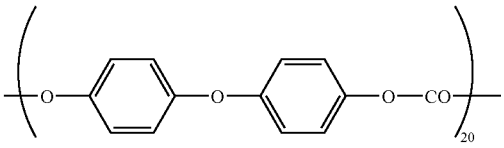

Unit B

Binder 2

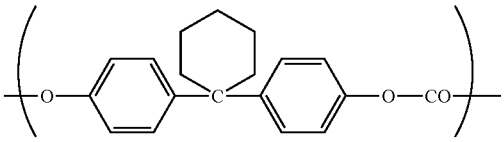

Binder 3

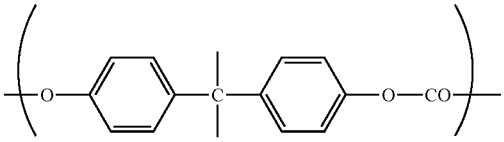

Evaluation

Each of the foregoing electrophotographic photoreceptors was loaded onto printer Magi Color 2430DL (produced by Konica Minolta Corp.), provided with a controller capable of outputting various image patterns and evaluated with respect to evaluation items described below. Deposition of charge transport material:

A solid black image was outputted under high temperature and high humidity (30° C., 85% RH) and observed for presence/absence of white spots. Corresponding portions were observed through a laser microscope at a magnification of approximately 50 times and the number of sites at which deposits were observed in the charge transport layer and evaluated based on the following criteria, in which grade 3 or higher is an acceptable level in practice.

5: 0
4: 1-2
3: 3-10
2: 11-30
1: 31 or more

Color Spotting:

An overall white image was outputted under high temperature and high humidity (30° C., 85% RH) and the number of color spots was counted, based on the following criteria, in which grade 3 or more is an acceptable level in practice.

5: 0
4: 1-2
3: 3-10
2: 11-30
1: 31 or more

Filming:

Under low temperature and low humidity (10° C., 20% RH), 5,000 sheets of a mixed image of YMCL single color texts, having a printing factor of 2% for each color were outputted at a one-sheet intermittency and the presence/absence of a short white line which emerged on a circumferential cycle of the photoreceptor was observed and evaluated based on the following criteria:

1: none observed
2: observed only in a 1-by-1 image,
3: observed even in a 2-by-2 image,
4: observed even in a 3-by-3 image
5: observed even in a 4-by-4 image.

Herein, an n-by-n image refers to a checkerwise halftone image comprised of black and white n-pixel square.

Stability of Image Density

Under high temperature and high humidity, 1,000 printed sheets of yellow, magenta, cyan and black characters, each having a print rate of 2%. Before and after that, a 2 by 2 halftone image was outputted and subjected to densitometry using a Macbeth densitometer to determine a coefficient of density variation (expressed in % and also denoted simply as CDV). A lower coefficient of density variation (CDV) is preferred but more than 10% is unacceptable in practice.

According to the invention, there were obtained electrophotographic photoreceptors which were uniform without causing deposition of a charge transport material, and exhibiting no black-spot defects with minimized image defects due to filming.

What is claimed is:

1. An electrophotographic photoreceptor comprising on an electrically conductive support an intermediate layer, a charge generation layer and a charge transport layer in this order, wherein the charge transport layer comprises a charge transport material represented by formula (1) and a compound represented by formula (2), and a content of the compound of formula (2) is not less than 100 ppm and not more than 5000 ppm:

TABLE 1

| Photo- | | Charge Transport Layer | | | Drying Condition | | Residual Solvent | Evaluation | | | | |
|---|---|---|---|---|---|---|---|---|---|---|---|---|
| receptor No. | Intermediate Layer | Solvent (ratio) | CTM (ratio) | Binder | temperature (° C.) | Time (min) | Solvent (ppm) | CTM Deposit | Color Spot | Filming | CDV* (%) | Remark |
| 1 | 1 | THF/Tol (95/5) | p (100/0) | 1 | 110 | 80 | Tol (100) | 4 | 4 | 4 | −3.5 | Inv. |
| 2 | 1 | THF/Tol (90/10) | p (100/0) | 1 | 110 | 60 | Tol (200) | 4 | 5 | 4 | −3.8 | Inv. |
| 3 | 1 | THF/Tol (80/20) | p (100/0) | 1 | 100 | 60 | Tol (500) | 5 | 5 | 5 | −4.2 | Inv. |
| 4 | 1 | THF/Tol (80/20) | p (100/0) | 1 | 95 | 50 | Tol (1500) | 5 | 5 | 5 | −4.3 | Inv. |
| 5 | 1 | THF/Tol (80/20) | p (100/0) | 1 | 90 | 60 | Tol (3000) | 5 | 5 | 5 | −4.9 | Inv. |
| 6 | 1 | THF/Tol (60/40) | p (100/0) | 1 | 85 | 50 | Tol (5000) | 5 | 5 | 5 | −7.3 | Inv. |
| 7 | 1 | THF/Xy (80/20) | p (100/0) | 1 | 140 | 80 | Xy (3200) | 5 | 5 | 5 | −6.5 | Inv. |
| 8 | 1 | MC/CB (80/20) | p (100/0) | 1 | 130 | 80 | CB (300) | 3 | 4 | 4 | −4.6 | Inv. |
| 9 | 1 | THF/Tol (80/20) | p/m (90/10) | 1 | 95 | 50 | Tol (1200) | 4 | 5 | 5 | −5.3 | Inv. |
| 10 | 1 | THF/Tol (80/20) | p/m (80/20) | 1 | 95 | 50 | Tol (1000) | 4 | 5 | 5 | −5.2 | Inv. |
| 11 | 1 | THF/Tol (80/20) | p/m (60/40) | 1 | 95 | 50 | Tol (300) | 3 | 4 | 4 | −4.8 | Inv. |
| 12 | 1 | THF/Tol (80/20) | p (100/0) | 2 | 100 | 60 | Tol (300) | 4 | 4 | 4 | −5.6 | Inv. |
| 13 | 1 | THF/Tol (80/20) | p (100/0) | 3 | 100 | 60 | Tol (200) | 4 | 5 | 4 | −5.8 | Inv. |
| 14 | 2 | THF/Tol (80/20) | p (100/0) | 1 | 95 | 50 | Tol (1500) | 5 | 4 | 5 | −5.6 | Inv. |
| 15 | 3 | THF/Tol (80/20) | p (100/0) | 1 | 95 | 50 | Tol (1500) | 5 | 4 | 5 | −5.5 | Inv. |
| 16 | 4 | THF/Tol (80/20) | p (100/0) | 1 | 95 | 50 | Tol (1500) | 5 | 3 | 5 | −7.4 | Inv. |
| 17 | 1 | Tol (0/100) | p (100/0) | 1 | 140 | 80 | Tol (2000) | 5 | 5 | 5 | −8.9 | Inv. |
| 18 | 1 | THF (100/0) | p/m (80/20) | 1 | 100 | 60 | — | 1 | 2 | 2 | −7.8 | Comp. |
| 19 | 1 | THF/Tol (80/20) | m (0/100) | 1 | 100 | 60 | Tol (300) | 2 | 1 | 2 | −11.6 | Comp. |
| 20 | 1 | THF/Tol (80/20) | p (100/0) | 1 | 150 | 80 | Tol (80) | 2 | 2 | 5 | −7.5 | Comp. |
| 21 | 4 | THF/Tol (20/80) | p (100/0) | 1 | 80 | 40 | Tol (6000) | 5 | 2 | 5 | −13.5 | Comp. |

*CDV: coefficient of density variation formula (1)

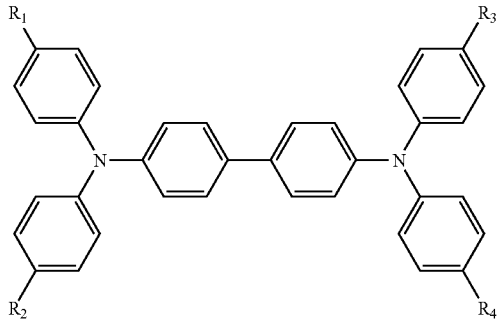

wherein $R_1$, $R_2$, $R_3$ and $R_4$ each are independently a hydrogen atom or a methyl group, formula (2)

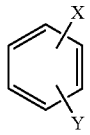

wherein X and Y each are independently a hydrogen atom, an alkyl group, an alkoxy group or a halogen atom, provided that X and Y both are not hydrogen atoms.

2. The electrophotographic photoreceptor of claim 1, wherein the charge transport material of formula (1) accounts for at least 80% by mass of total charge transport materials included in the charge transport layer.

3. The electrophotographic photoreceptor of claim 1, wherein at least two of R1, $R_2$, $R_3$ and $R_4$ of formula (1) are methyl groups and at least one of X and Y of formula (2) is an alkyl group.

4. The electrophotographic photoreceptor of claim 3, wherein $R_1$ and $R_3$ are methyl groups and $R_2$ and $R_4$ are hydrogen atoms, and X is a methyl group and Y is a hydrogen atom.

5. The electrophotographic photoreceptor of claim 1, wherein the content of the compound of formula (2) is not less than 500 ppm and not more than 3000 ppm.

6. The electrophotographic photoreceptor of claim 1, wherein the charge transport layer comprises a binder which is a polycarbonate.

7. The electrophotographic photoreceptor of claim 1, wherein the charge generation layer comprises a charge generation material which is a Y-titanyl phthalocyanine.

8. The electrophotographic photoreceptor of claim 1, wherein the intermediate layer comprises N-type semiconductor particles having a number average primary particle size of 3 to 100 nm.

9. A method of preparing an electrophotographic photoreceptor comprising on an electrically conductive support an intermediate layer, a charge generation layer and a charge transport layer in this order, the method comprising forming the intermediate layer on the support, forming the charge generation layer on the intermediate layer, and forming the charge transport layer on the charge generation layer, wherein the charge transport layer is formed by coating a coating solution including a charge transport material represented by formula (1) and a solvent represented by formula (2):

formula (1)

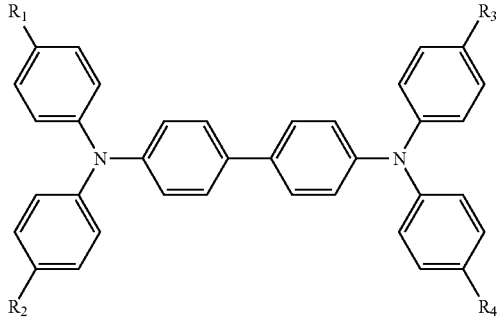

wherein $R_1$, $R_2$, $R_3$ and $R_4$ each are independently a hydrogen atom or a methyl group, formula (2)

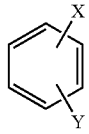

wherein X and Y each are independently a hydrogen atom, an alkyl group, an alkoxy group or a halogen atom, provided that X and Y both are not hydrogen atoms.

10. The method of claim 9, wherein the charge transport material of formula (1) accounts for at least 80% by mass of total charge transport materials included in the coating solution of the charge transport layer and the solvent of formula (2) accounts for at least 10% by volume of total solvents included in the coating solution of the charge transport layer.

11. The method of claim 9, wherein at least two of $R_1$, $R_2$, $R_3$ and $R_4$ of formula (1) are methyl groups and at least one of X and Y of formula (2) is an alkyl group.

12. The method of claim 11, wherein $R_1$ and $R_3$ are methyl groups and $R_2$ and $R_4$ are hydrogen atoms, and X is a methyl group and Y is a hydrogen atom.

13. The method of claim 9, wherein a content of the compound of formula (2) is not less than 500 ppm and not more than 3000 ppm.

14. The method of claim 9, wherein the charge transport layer comprises a binder which is a polycarbonate.

15. The method of claim 9, wherein the charge generation layer comprises charge generation material which is a Y-titanyl phthalocyanine.

16. The method of claim 9, wherein the intermediate layer is formed by coating a coating solution including N-type semiconductor particles having a number average primary particle size of 3 to 100 nm, and the N-type semiconductor particles are prepared by a process comprising dispersing N-type semiconductor particles by using spherical media comprised of zirconium oxide and having an average particle size of 0.1 or 0.5 mm.

* * * * *